US007765934B2

(12) United States Patent
Spatz et al.

(10) Patent No.: US 7,765,934 B2
(45) Date of Patent: Aug. 3, 2010

(54) LEAD-FREE PROJECTILE

(75) Inventors: Peter Spatz, Thun (CH); Hans Baumgartner, Thun (CH); Fritz Schaer, Spiezwiler (CH)

(73) Assignee: Ruag Ammotec, Thun (CH)

( * ) Notice: Subject to any disclaimer, the term of this patent is extended or adjusted under 35 U.S.C. 154(b) by 0 days.

(21) Appl. No.: 11/595,332

(22) Filed: Nov. 9, 2006

(65) Prior Publication Data

US 2007/0204758 A1 Sep. 6, 2007

Related U.S. Application Data

(63) Continuation of application No. PCT/CH2005/000257, filed on May 9, 2005.

(51) Int. Cl.
*F42B 12/06* (2006.01)

(52) U.S. Cl. ..... 102/518; 102/508; 102/507

(58) Field of Classification Search ..... 102/503, 102/507, 508, 509, 514, 518, 519; D22/116
See application file for complete search history.

(56) References Cited

U.S. PATENT DOCUMENTS

| | | | | | |
|---|---|---|---|---|---|
| 1,493,614 | A * | 5/1924 | Dickerman | ..... | 102/510 |
| 4,384,528 | A * | 5/1983 | Moore et al. | ..... | 102/503 |
| 4,517,897 | A * | 5/1985 | Kneubuhl | ..... | 102/439 |
| 4,612,860 | A * | 9/1986 | Flatau | ..... | 102/518 |
| 4,655,140 | A * | 4/1987 | Schirneker | ..... | 102/508 |
| 4,697,525 | A * | 10/1987 | Bocker et al. | ..... | 102/518 |
| 4,895,077 | A * | 1/1990 | Miethlich et al. | ..... | 102/517 |
| 5,069,139 | A * | 12/1991 | Denis | ..... | 102/518 |
| 5,175,392 | A * | 12/1992 | Denis | ..... | 102/364 |
| 5,259,320 | A * | 11/1993 | Brooks | ..... | 102/509 |
| 5,349,907 | A * | 9/1994 | Petrovich et al. | ..... | 102/506 |
| 5,365,853 | A * | 11/1994 | Petrovich et al. | ..... | 102/507 |
| 5,641,937 | A | 6/1997 | Carter et al. | | |
| 6,070,532 | A * | 6/2000 | Halverson | ..... | 102/501 |
| 6,374,743 | B1 * | 4/2002 | Hug et al. | ..... | 102/518 |
| 6,845,717 | B1 * | 1/2005 | Sauvestre | ..... | 102/518 |
| 6,971,315 | B2 * | 12/2005 | Knappworst et al. | ..... | 102/510 |
| 2007/0028793 | A1 * | 2/2007 | Sauvestre | ..... | 102/508 |

FOREIGN PATENT DOCUMENTS

| | | | |
|---|---|---|---|
| DE | 3840165 | A1 | 5/1990 |
| DE | 197 10 113 | A1 | 9/1998 |
| WO | WO 99/10703 | A1 | 3/1999 |
| WO | WO 01/18483 | A1 | 3/2001 |
| WO | WO 01/20244 | A1 | 3/2001 |

* cited by examiner

*Primary Examiner*—Benjamin P Lee
(74) *Attorney, Agent, or Firm*—Ladas + Parry LLP

(57) ABSTRACT

A small-bore projectile comprises a ductile outer jacket, a hard core, and a hollow jacket core. Kinetic energy of the projectile is substantially transmitted to the hard core when a target is hit such that said hard core penetrates the target. The outer jacket is supported by the jacket core that is located on the inside and mushrooms up into a deformed state upon impact without fragmenting. The projectile has good flying behavior and great final ballistic performance and can be produced in an entirely lead-free manner.

8 Claims, 3 Drawing Sheets

LEAD-FREE PROJECTILE

The present application is a Continuation of PCT International Application No. PCT/CH2005/000257, filed May 9, 2005.

The present invention relates to a lead-free small-bore jacketed projectile.

BACKGROUND OF THE INVENTION

Small-bore jacketed projectile ammunition is known in various designs. It may be divided into those with hard cores made of steel, into those with hard cores made from dense sintered material and those with a medium additional to the hard core such as lead, aluminum and/or air. Together with such a core, commercially available ammunition has a steel jacket, generally configured as a full jacket, i.e. a plated steel jacket or a jacket made from a copper/zinc alloy (tombac jacket). In this connection, the jacket receives one or more cores and further media and encloses said cores and media at least in a liquid-tight manner.

Small arms ammunition and a manufacturing process therefor is known from EP-A2-0 106 411. The correspondingly optimized projectiles principally serve as live ammunition for infantry and already have good aerodynamic properties. This ammunition, however, does not have the required high final ballistic energy required by marksmen, which is necessary for penetrating armour plating. A further drawback is the large amount of hard lead (98% Pb+2% Sn) in the core, which has a toxic effect on the environment both in blank ammunition and live ammunition and therefore is undesirable nowadays or even prohibited in some countries.

A jacketed projectile (WO 99/10703) of increased penetration performance and target accuracy has a hard core made of tungsten carbide and, as an additional medium, a soft core made of lead (Pb/Sn 60/40) which are held with an interference fit in a gastight manner via a brass disc in the jacket. Thus the escape of heavy metals and/or vapor when firing is prevented; a toxic effect is, however, still present in the target area. Additionally, the manufacture of such a projectile is costly and too expensive for mass use (infantry ammunition).

A further jacketed projectile for 9 mm bore pistols is marketed under the reference SWISS P SELF 9 mm Luger (RUAG Ammotec, Thun/Switzerland, formerly RUAG ammunition Thun/Switzerland). In this case, the projectile consists of two sleeves pushed inside one another, the inner sleeve sealed at the tail and open upwards, enclosing a large air space with the outer sleeve. This projectile is, however, only designed for soft targets and, in this case, is able to be driven through smoothly; it may be manufactured as lead-free.

A jacketed projectile with a bore of up to 15 mm is known from DE-A1-107 10 113 which comprises an ogival or conical front region, a cylindrical central part and a conically extending tail region. The ductile metallic jacket encloses a pointed hard core made of hardened steel or made of a sintered metal and is more or less freely held by a shoe-like or sheath-like support made from a ductile metal or made of synthetic material. The core is only in linear contact with the jacket in the region of an angular shoulder. The penetrative action of this projectile on armor plated targets is good; the target accuracy thereof is, however, markedly reduced. In particular with an oblique impact on the target, the front part of the projectile jacket splinters and deforms and thereby presses the hard core out of its initial symmetrical axial position which, as the effective cross-section becomes greater, at least reduces the penetration performance or even leads to ricochets. Additionally, the manufacture of the projectile is costly and, due to the more or less free positioning of the hard core, may not be carried out with great accuracy.

It is therefore the object of the invention to provide a small-bore projectile (small-bore=bore less than 0.5") suitable for hard targets, which may be manufactured economically, has a high penetration performance and target accuracy and does not release heavy metals on firing or in the target area. The projectile to be provided is intended, in particular, to contain no lead in the core. The projectile jacket is also intended not to splinter on a hard target.

BRIEF DESCRIPTION OF THE INVENTION

A projectile in accordance with the invention has an ogival or conical front region, a cylindrical central part, and a conically extending tail region, with an outer jacket of a copper/zinc alloy. The jacket encloses a hollow space. A hard core, made of steel or a sintered material, is inserted into the hollow space towards the projectile tip. A copper/zinc alloy jacket core having an interior hollow space open to a front face of the jacket core is attached with a form fit to the hard core. The front face of the hollow space may have a conical front face and positively rests against the hard core, sealing the hard core at its front face. The jacket core is in peripheral contact over its length with at least the tail region of the jacket in an interference fit.

Such a projectile may be easily manufactured and in a hard target (sheet metal) etc. transmits almost its entire kinetic energy to the hard core which penetrates the target. In this connection, the mass remains preserved at 100%; at the bullet hole a mushroom-shaped collar is formed by the jacket which corresponds to the original weight of the jacket. Thus it is proved that no heavy metals and/or metal vapor are released.

The projectile can also be configured without a hard core but with a jacket core with a hollow space in the form of a tapered aperture and in peripheral contact with the jacket in a friction fit. Such a construction exhibits a high final ballistic performance, despite there not being a hard core over the entire surface in cross-section, and in practical tests no fragmentation was detected at the target.

A projectile of the invention with an ogive-like outer shape and an air space formed between spherical cup surfaces of the tip and hard core is particularly advantageous with regard to ballistics. It has been shown, that the necessary pressing-in of the hard core may be carried out accurately and with relatively low forces. Additionally, the pulse transmission of the core, after a short displacement path, allows a penetration of the jacket with lower energy losses.

Incorporation of a conical tail region of the hard core in the prior embodiment can be very advantageous for the central pulse transfer from the jacket core to the hard core.

To a considerable extent, the flying behavior of the projectile is provided by the position of the center of gravity. The center of gravity may be optimized by the constructive design and dimensioning of the hard core and, in particular, of the hollow space (bore) in the jacket core.

Alloy tool steels are well suited to the hard core and may be machined and surface-treated by conventional means.

Use of identical materials for the outer jacket and the jacket core have proved to be very economical and also expedient with regard to density, assembly and thermal expansion.

A constriction having an outer jacket with a circumferential peripheral constriction on which the front end of a cartridge sleeve is flanged improves the connection to the cartridge sleeve and allows the simple assembly thereof.

A thickening of the jacket in its front region can reduce ricochets during acute angle firing at hard targets and also serves to determine the center of gravity.

The aforementioned embodiments of the projectile appear to be particularly suitable for a small bore projectile having a bore of about 5.56 mm (0.220"-0.224").

The current demand for lead-free projectiles is ensured with a proper choice of material. Standard filling material made of heavy metal in conventional projectiles may also be dispensed with, as the position of the center of gravity may be optimally adjusted by the dimensioning of the individual components and hollow spaces.

BRIEF DESCRIPTION OF THE DRAWINGS

The invention is disclosed hereinafter with reference to the embodiments and drawings, in which.

DETAILED DESCRIPTION OF THE INVENTION

Figure 1:
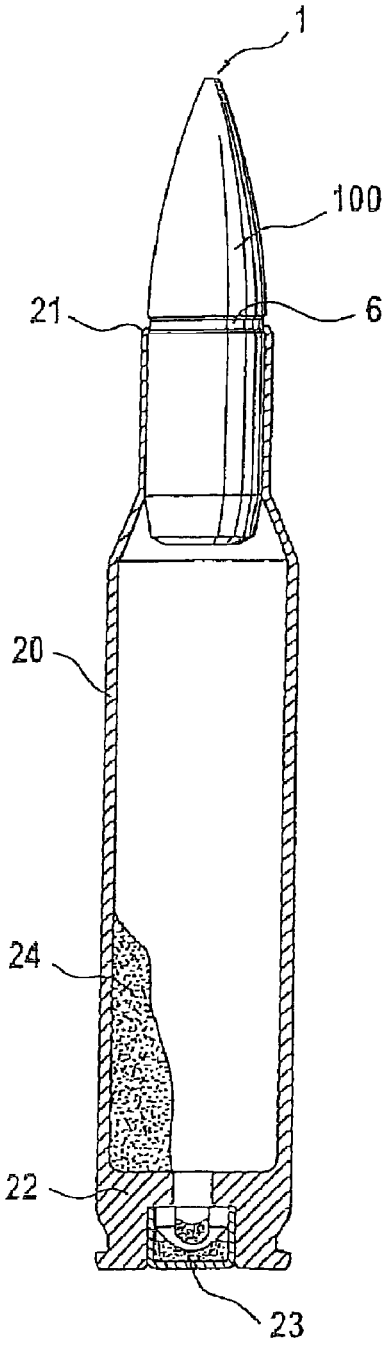
FIG. 1 is a projectile according to the invention, fitted into a cartridge sleeve known per se, shown partially broken away.

The tip of a projectile 100 is denoted in FIG. 1 by 1. A flange 21 is inserted into the reduced diameter of a peripheral constriction 6, and which is a component of a cartridge 20 known per se. A standard explosive 24 is located in the cartridge 20, which acts as a propellant for the projectile 100. An impact fuse 23 (SINTOX, trademark of the firm RUAG Ammotec GmbH, Fürth, DE) is inserted in a base 22 of the cartridge 20.

Figure 2:
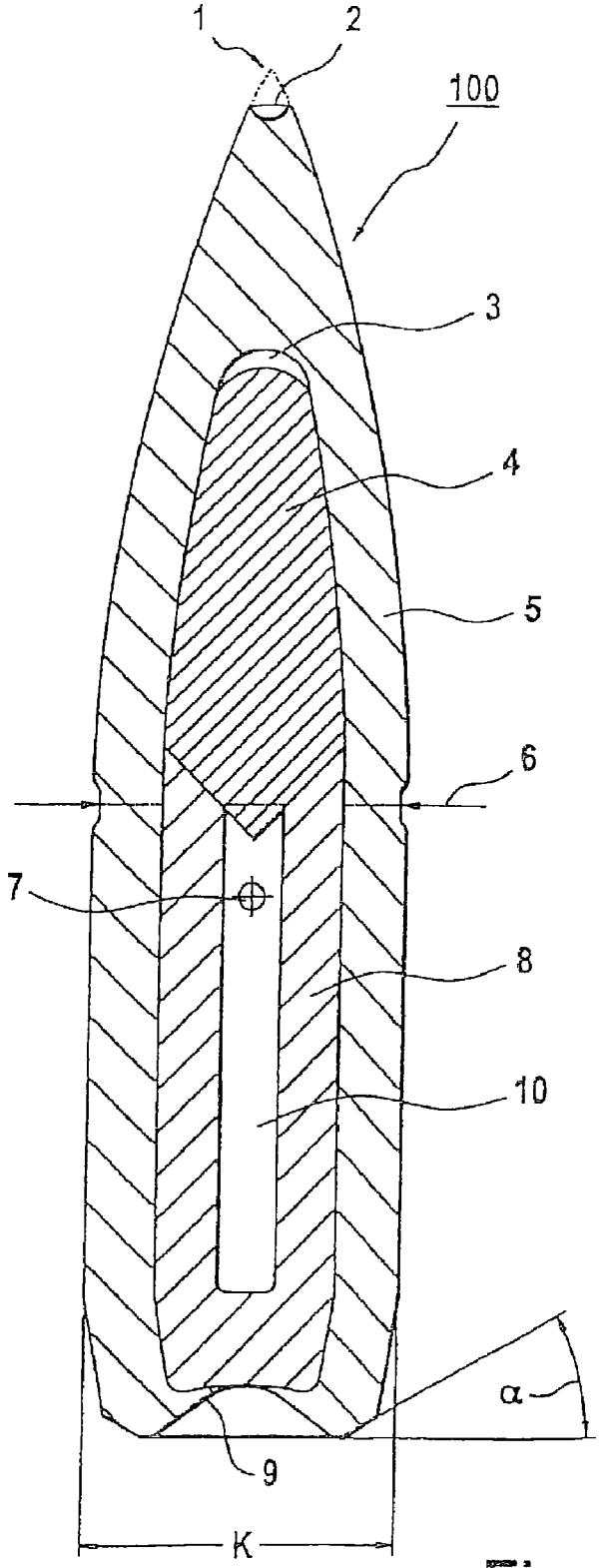
FIG. 2 is a sectional view through a preferred embodiment of the projectile in FIG. 1.

The preferred rotationally symmetrical projectile 100 is shown in FIG. 2 in an enlarged sectional view.

The actual tip 1 is imaginary; in reality it is a tip in the shape of a spherical cup 2 formed in the front end of outer jacket 5, the front region of which is ogical or conical. A small air space 3 is located inside the projectile 100, which is formed between a hard core 4 and the outer jacket 5, as a result of the different radii of the front portion of a central hollow space in the jacket and the front of the hard core. A jacket core 8 is attached to the hard core 4 with a form fit, and which has the central hollow space 10 in the form of a blind hole. The center of gravity 7 of the projectile is located in the upper part of said hollow space. The outer peripheral annular groove 6 is located thereover, which is illustrated here, portrayed as a diameter; see FIG. 1. Below the groove the central region of the outer jacket is cylindrical.

At the tail, the end of the jacket 5 is conically tapered and terminates in a stepped portion at an angle a of 30°, which stepped portion merges with a terminal flange 9 and holds the two cores 4 and 8 together with an interference fit.

The diameter of the projectile 100, denoted by K, the bore, in the present case is 5.56 mm and is of the SS 109 type. The diameter 6 of the constriction is 5.45 mm. The hard core 4 weighs 4 g and is made of hardened tool steel (material according to DIN 1.5511) and has been phosphatized after carburizing (penetration depth=0.3-0.5 mm). The surface hardness is 570 HV1.

In this embodiment, the hard core 4 has a lower conical tip of 90° which rests positively in a corresponding recess (countersink) in the upper part of the jacket core 8. This configuration may be varied at will; a similar form of central centering action is, however, advantageous, which facilitates the insertion or pressing-in of the core and ensures the rotational symmetry of the projectile.

A hard core 4 made from tombac has also proved expedient; surprisingly, this produces a similar final ballistic performance.

The projectiles may be manufactured by standard production devices and substantially by deep drawing and pressing.

The hard core may also be made from other materials, for example from sintered materials such as tungsten carbide. Other projectile jackets are also conceivable, which have a similar ductility to tombac. The jacket core may also consist of other materials which have a similar or greater density. In all alloys, however, consideration has to be given to the deposition of heavy metal during firing and at the target.

Figure 3:
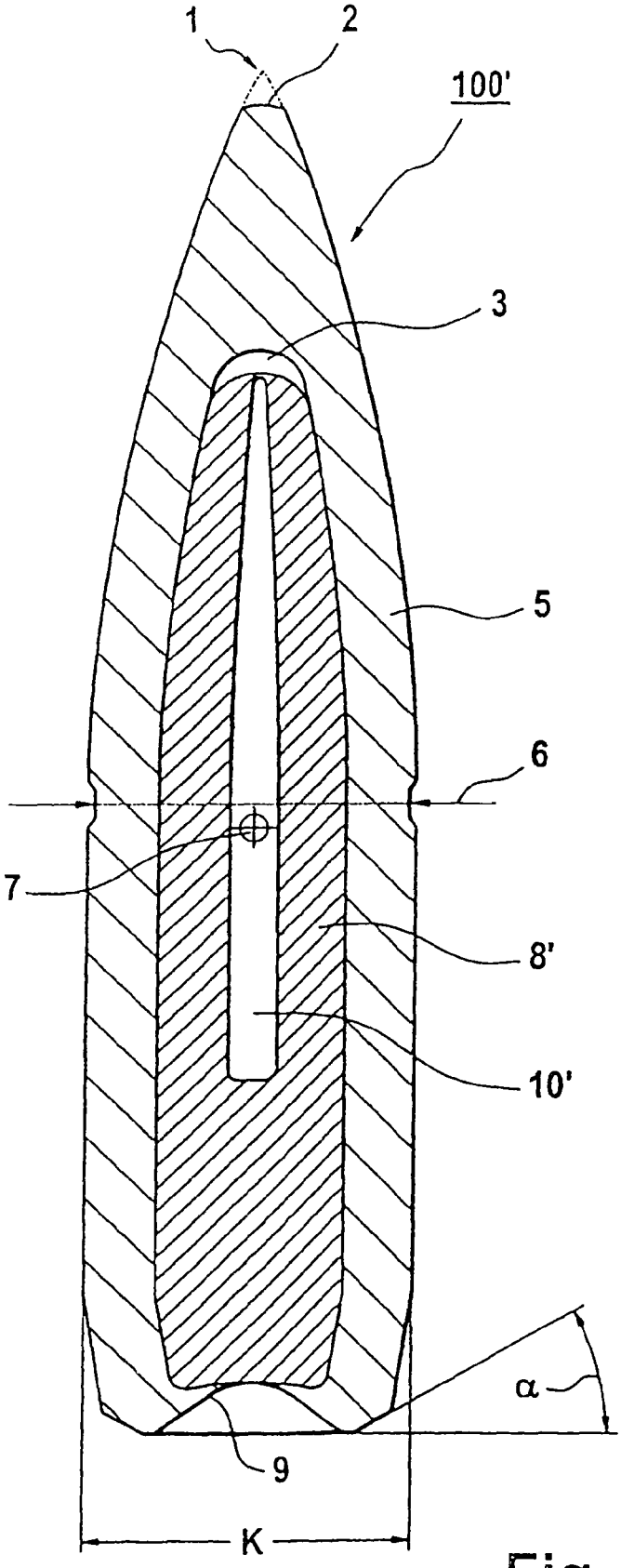
FIG. 3 is a sectional view of an alternative solution of a lead-free projectile.

In FIG. 3 a variant of the aforementioned projectile is shown, in this connection the same functional parts are provided with the same reference numerals.

In contrast to the subject according to FIG. 2, in this case, the hard core is dispensed with. A single jacket core 8' similarly fills up the space of the hard core 4, in FIG. 2. The associated hollow space 10' may be shortened relative to the hollow space 10 and has a smaller diameter. As a result, the mass of the entire projectile 100' is increased, so that approximately the same final ballistic performance and effect is achieved at the target.

At the front face of the jacket core, the hollow space 10' tapers and is at least almost closed so that, together with the front part of the outer jacket 5, a compact tip is produced when striking the target.

In both variants, measuring results, theoretical observations and comparisons with other projectiles (prior art) show exceptionally good results:

The hollow space 10 and/or 10' allows a transverse contraction in the gun barrel (rifle) which, relative to solid projectiles, leads to a reduction in wear (abrasion), in particular in the rifling grooves. At the same time, the firing velocity $v_0$ of the projectile 100 and/or 100' at the muzzle is greater than with projectiles without a hollow space 10 and/or 10'.

The low drag coefficient $c_d$ of a 5.56 mm projectile (SS109 type) according to the invention, after a 570 m flight distance (NATO target), still leads to an impact velocity of 470 m/s; the steel plate used was Stanag 4172 of 3.5 mm thickness with 55-70 HRB hardness (400N/mm$^2$) and was perforated smoothly.

Precise spin stabilization acts positively on the stability and reproducibility of the flight path, even with side wind. As a result of the choice of materials and the high firing velocity, the kinetic energy is greater than with comparable projectiles, as tests also showed. The precision of a standard weapon may be increased with the subject of the invention. Thus, for example, all fired shots (repeated fire) at a target distance of 25 m were located in a dispersion circle with a diameter<50 mm. At a firing distance of 300 m, a standard deviation $S_D$<35 mm could be detected. In practice, this means that of 20 fired shots, of which 18 are located in a circular surface with a diameter of 110 mm, only two projectiles struck approximately 80 mm offset from the center (target).

As tests in firing against soap have shown, the requirements of the ICRC (International Committee of the Red Cross) are also completely fulfilled, with regard to wound ballistics, in contrast with numerous other projectiles according to the prior art.

Figure 4A:
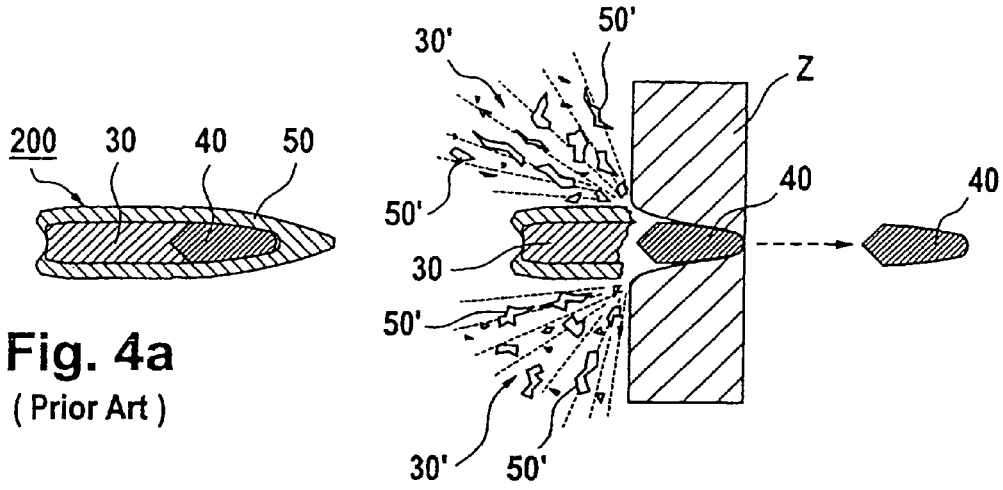
Fig. 4a ( Prior Art )
FIG. 4*a* is a depiction of a conventional projectile (according to the prior art) when striking the target.

FIG. 4*a* shows a conventional hard core projectile 200 (prior art) before and during impact on the target Z (steel). The steel jacket 50 explodes at the target Z, a hard core 40 consisting of tungsten or steel penetrates the target Z, whilst, due to the high kinetic energy, the lead core 30 which follows behind is partially liquefied and even partially vaporized by sublimation on impact. This may be seen by a vapor cloud 30' which, after the condensation thereof, also leaves traces of lead at the target.

A combination of elastic and plastic impact with high deformability takes place in the projectile 200 (fragmentation of material on all sides). The material of the projectile 200 which is splintered at the target Z and which may still be detected, no longer corresponds to its initial weight at the muzzle.

Figure 4B:
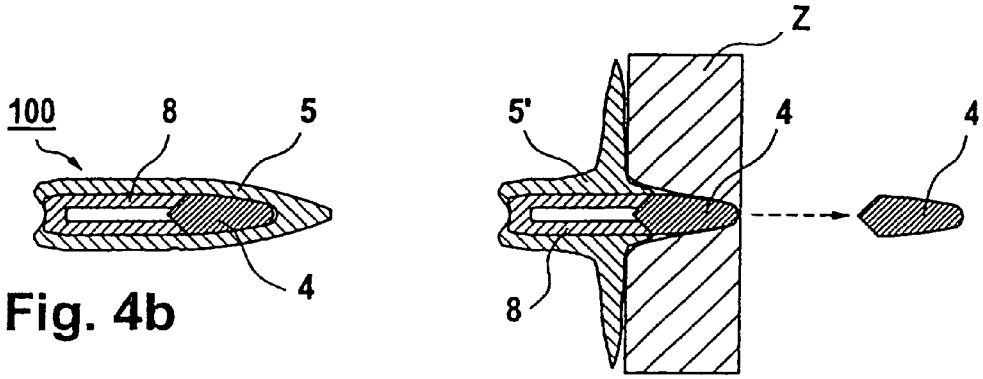
FIG. 4*b* is a depiction of a projectile according to FIG. 2 when striking the target.

In contrast, on one projectile 100, in FIG. 4*b*, the identical mass may also be detected at the target Z. In this connection, the hard core 4 (steel or tombac) also penetrates the target Z. The outer jacket 5 mushrooms up at the target Z into a deformed jacket 5' and transmits almost 100% of the kinetic energy to the hard core 4 via its similarly ductile jacket core 8; there is no fragmentation of material, either on the jacket 5 or on the jacket core 8. The pulse direction remains preserved.

Figure 4C:
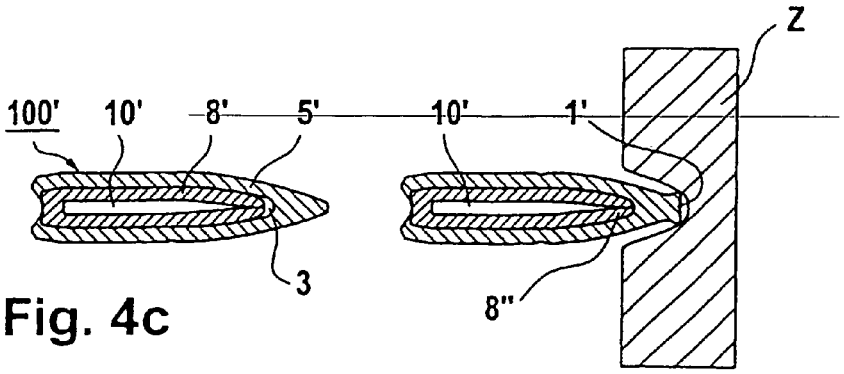
FIG. 4*c* is a depiction of a projectile according to FIG. 3 when striking the target.

FIG. 4*c* shows a similar view: the projectile 100' which is modified relative to FIG. 4*b* is squashed at the target Z and penetrates with a tip 1' which is now flattened. The pulse direction also remains preserved, the jacket core 8' is displaced on impact into the air space 3, compressed and squashed which is denoted here by 8".

We claim:

1. A small-bore projectile having an ogival or conical front region, a cylindrical central part and a conically extending tail region, further comprising:

an outer jacket of a copper/zinc alloy, the jacket having a tip and fully enclosing a hollow space;

a hard core made of steel or a sintered material inserted into the hollow space towards the tip and having a outwardly projecting conical rear face tapering to a point;

a jacket core made of a copper/zinc alloy having a front face attached with a form fit to a rear of the hard core;

the jacket core front face being inwardly conical and having a surface portion positively resting against a corresponding portion of the conical rear face of the hard core and sealing said hard core to the front face, a single interior cylindrical hollow space being present within the jacket core extending downwardly from said front face a majority length of the jacket core and with a sidewall of the hollow space being bounded by the jacket core and a top being bounded by the point portion of the rear face of the hard core; and the jacket core being in contact on a periphery over its entire length with at least the tail region of the jacket and being held with an interference fit;

the projectile being entirely lead-free.

2. A small-bore projectile according to claim 1, a front portion of the hollow space of the jacket being in the shape of a spherical cup;

the hard core having a shape of a spherical cup at a tip thereof, the radius of curvature of the spherical cup of the hollow space of the jacket being larger than the radius of curvature of the tip of the hard core, whereby an air space portion of the hollow space of the jacket is present between the outer jacket and the hard core.

3. A small-bore projectile according to claim 2, the material of the jacket in its front region, relative to its cylindrical region and its tail region, having a thickening which is at least a factor of 2.

4. A small-bore projectile according to claim 1 or 2, a center of gravity of the projectile being located in a longitudinal axis and in a region of the hollow space of the jacket core.

5. A small-bore projectile according to claim 1 or 2, the hard core consisting of alloyed tool steel or sintered material of high density.

6. A small-bore projectile according to claim 1, the outer jacket and the jacket core consisting of an identical copper/zinc alloy.

7. A small-bore projectile according to claim 1, the outer jacket comprising a circumferential, peripheral constriction, on which a front end of a cartridge sleeve is flanged.

8. A small-bore projectile according to claim 1, wherein said projectile has a bore of 5.56 mm (0.223" to 0.224").

* * * * *